United States Patent [19]

Cary et al.

[11] 4,437,619

[45] Mar. 20, 1984

[54] CATENARY CONTROLLER

[75] Inventors: Hall Cary, c/o 8074 Hubbard Valley Rd., Seville, Ohio 44273; John F. Marquard, Strongsville, Ohio

[73] Assignee: Hall Cary, Seville, Ohio ; a part interest

[21] Appl. No.: 260,912

[22] Filed: May 6, 1981

[51] Int. Cl.[3] ..... B65H 23/20

[52] U.S. Cl. ..... 242/75.51; 226/42; 226/45; 367/96; 318/6; 318/606; 318/685

[58] Field of Search ..... 242/75.51, 75.52, 75.44, 242/183, 184, 185, 182, 45; 226/42, 45; 318/685, 606, 6; 367/96

[56] References Cited

U.S. PATENT DOCUMENTS

| | | | |
|---|---|---|---|
| 2,379,132 | 6/1945 | Cook . | |
| 3,177,749 | 4/1965 | Best et al. . | |
| 3,472,439 | 10/1969 | Eastcott | 242/75.44 X |
| 3,771,114 | 11/1973 | Buchan et al. | 226/45 X |
| 3,785,588 | 1/1974 | Schramm | 242/75.51 X |
| 3,818,261 | 6/1974 | Clarke | 318/685 X |
| 3,890,547 | 6/1975 | Keck . | |
| 4,092,569 | 5/1978 | Herr et al. | 318/685 X |
| 4,195,791 | 4/1980 | Frazee, Jr. . | |
| 4,199,246 | 4/1980 | Muggli | 367/96 X |
| 4,250,130 | 2/1981 | LaSpisa et al. . | |
| 4,338,645 | 7/1982 | Mohri et al. | 242/75.51 |
| 4,384,665 | 5/1983 | Waddington | 226/42 |

FOREIGN PATENT DOCUMENTS

| | | | |
|---|---|---|---|
| 655582 | 1/1963 | Canada | 367/96 |
| 1263443 | 3/1968 | Fed. Rep. of Germany | 367/96 |
| 1133121 | 11/1968 | United Kingdom | 242/75.51 |

OTHER PUBLICATIONS

IBM Technical Disclosure Bulletin, vol. 13, No. 8, Jan. 1971.

*Primary Examiner*—John M. Jillions
*Attorney, Agent, or Firm*—Pearne, Gordon, Sessions, McCoy, Granger & Tilberry

[57] ABSTRACT

A catenary-like section of traveling web material hanging between a support point and a stepping motor-driven reel rotating to collect or dispense the material is maintained by regulating the stepping motor rate of rotation in accordance with a control signal output of an ultrasonic transducer operating in the pulse/echo mode to continuously monitor the distance between the low point of the catenary-like section and the transducer. A microcomputer connected between the transducer and the motor accelerates and decelerates the rate of stepping motor rotation in accordance with a predetermined program to maintain the catenary section during changes in the distance between the section low point and the transducer.

14 Claims, 6 Drawing Figures

CATENARY CONTROLLER

BACKGROUND OF THE INVENTION

This invention is directed generally to the tensionless winding and unwinding of flexible material onto and off a reel, and in particular to the controlling of a catenary-like section of traveling web material suspended between a support point and a motor-driven rotating reel collecting or dispensing the material.

U. S. Pat. No. 4,195,791 discloses a method and means for monitoring in a contactless manner the low point of a catenary-like section of a traveling optic fiber in order to regulate a spooling motor rotatably driving a take-up reel. The '791 patent utilizes a video camera positioned alongside the section low point to monitor its rise and fall without physically contacting the material forming the catenary-like section. This feature advantageously permits the tensionless winding of very fragile materials (e.g., glass strands, integrated circuit conductor webs, and the like) onto a take-up reel whose rate of rotation is regulated by the video camera signal output to maintain the low point of the catenary-like section at a predetermined position so as to minimize winding tension (determined only by the weight of material forming the catenary section).

It is an object of the present invention to provide a catenary controller of the contactless type that is more rugged and less costly than the type of controller illustrated by the earlier-noted '791 patent.

It is a further object of the present invention to provide a catenary controller of the contactless type that is adaptable to controlling a wide range of materials having different electrical conductivity characteristics, geometries, dimensions, and compositions.

It is a still further object of the present invention to provide a catenary controller of the contactless type that is suitable for use in an environment when vision-obscuring, airborne dirt and dust would hamper the proper operation of optical catenary controller systems of the type illustrated by the '791 patent.

SUMMARY OF THE INVENTION

In accordance with the present invention, an ultrasonic transducer is positionable a spaced distance from the low point of a catenary-like section of traveling material suspended between a support point and a rotating reel collecting or dispensing the material. The transducer operates in the pulse/echo mode to provide an output signal indicative of the distance between the section low point and the transducer. A control means, preferably including a preprogrammed microcomputer, responds to the transducer output signal to vary the rotation rate of the reel to maintain a predetermined distance between the transducer and the section low point. Preferably, the reel is rotatably driven by a direct current stepping motor incrementally driven by the digital output of the microcomputer.

BRIEF DESCRIPTION OF THE DRAWINGS

A fuller understanding of the invention may be had by referring to the following description and claims taken in conjunction with the accompanying drawings, wherein

DETAILED DESCRIPTION OF THE PREFERRED EMBODIMENT

Figure 1:
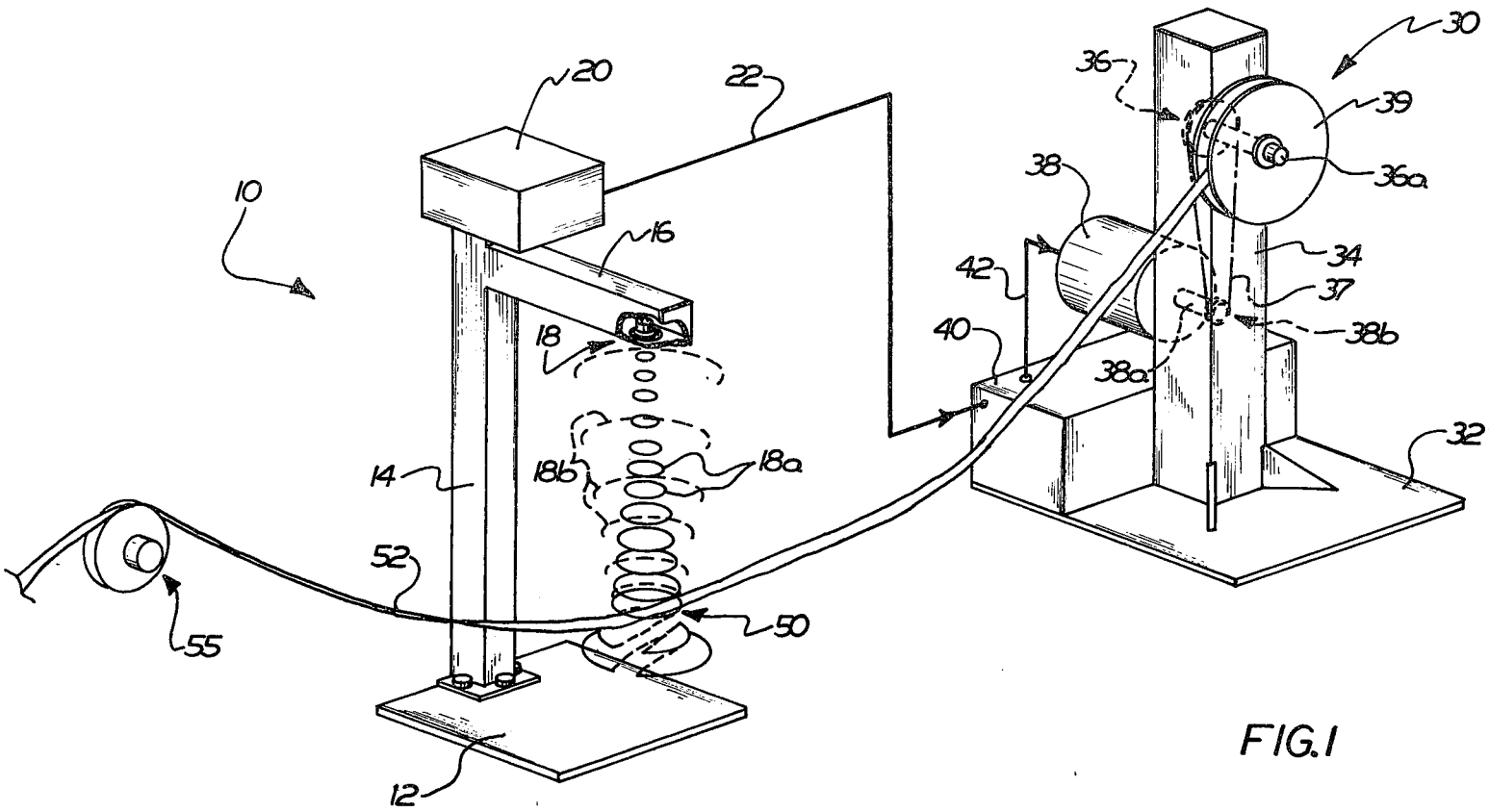
FIG. 1 is a perspective view of a catenary controller in accordance with the present invention.

In accordance with the present invention, and with particular reference to FIG. 1, there is illustrated a catenary controller including two major structures, namely, an electronic control and sensor unit 10 and a reeling unit 30 whose operation is regulated by the control and sensor unit 10. The units 10, 30 are separately supported and movable relative to each other to permit their being individually positioned for proper control of a catenary section of traveling (linearly moving) web material 52 suspended or hanging between a support point 55 (such as an idler roller or the like) and a motor-driven reel 39 onto and around which the traveling material is wound (or from which it is unwound). The low point 50 of the catenary-like section of traveling material 52, such as, for example, a very fragile metal web of punch press formed integrated circuit conductors, will move up and down depending upon the difference between feed rates of the material into and out of the catenary-like section. The low point 50 will maintain a constant level when the feed rates into and out of the catenary-like section are equal. It is the position of this low point 50 that is monitored by the control unit 10 to regulate the rotational speed of the reel 39 so as to maintain the low point 50 at a generally fixed position, thus applying a generally constant winding and unwinding tension on the material 52 (i.e., a uniform catenary section will be of a generally constant weight, thus applying a generally constant gravity-generated tension force on the material 52).

When the material 52 is of a very fragile nature, it is essential that the low point 50 of the catenary section be monitored in a contactless manner, since physical contact of a sensing element with the traveling web material 52 could damage it. Thus, in accordance with the invention, an ultrasonic transducer 18 operating in the pulse/echo mode senses the low point 50 to monitor the distance between the transducer 18 and the low point 50 of the catenary section so as to maintain the low point 50 generally at a set distance (e.g., 26 inches) spaced from the transducer. The transducer 18 is located at the distal end of a horizontal cantilever-like arm 16, which in turn is supported at the upper portion of a vertical support 14 attached to a floor-supported, pedestal-like control unit base 12. Located atop the vertical support 14 is a controller 20. Preferably, the transducer is located directly above the section low point 50 as illustrated.

In a similar manner, the reeling unit 30 includes a pedestal-like reeling unit base 32 supporting the earlier-noted reel 39 which is positioned at the top portion of a vertical member 34. A motor, in the preferred illustrated form of a permanent magnet direct current stepping motor 38, is mounted to the vertical support member 34 at a position below the reel 39 and provides a rotating shaft **38*a*, which in turn provides a stepping motor drive sprocket 38*b* which is positively connected via a drive chain 37 to a driven reel sprocket 36. The reel sprocket 36 is bearing-supported in a conventional manner by the vertical member 34 and provides a reel support shaft 36***a* upon which the reel 39 is nonrotatably mounted, wherein for each discrete angular rotation motion (e.g., 1.8°) of the stepping motor shaft 38*a*, the reel 39 will rotate through a proportional angular increment. Preferably, the drive sprocket diameter is less than the driven sprocket diameter to provide for a reduction drive (e.g., 3:1) to permit the motor 38 to incrementally drive heavy reel loads.

The controller 20 functions to provide variable frequency motor control pulses of uniform magnitude via a motor control line 22 (schematically illustrated) to a sequence translator 40 (mounted on the base 32), which in turn powers the stepping motor 38 via a motor power line 42 (schematically illustrated). The line 22, in the form of a flexible cable, is long enough to permit movement of the control unit-supported transducer 18 to a position directly above the low point 50 of the catenary-like section of material 52 so that an interrogation pulse (illustrated by radiation lines 18*a*) impinges on the low point 50 in a generally perpendicular manner for reflection back to the transducer 18 as an echo pulse (illustrated by reflection lines 18*b*) constituting a reflected portion of the interrogation pulse (typical pulse/echo elapsed time through air at frequency 50–60 kilohertz - 1.78 ms/ft.).

Figure 2:
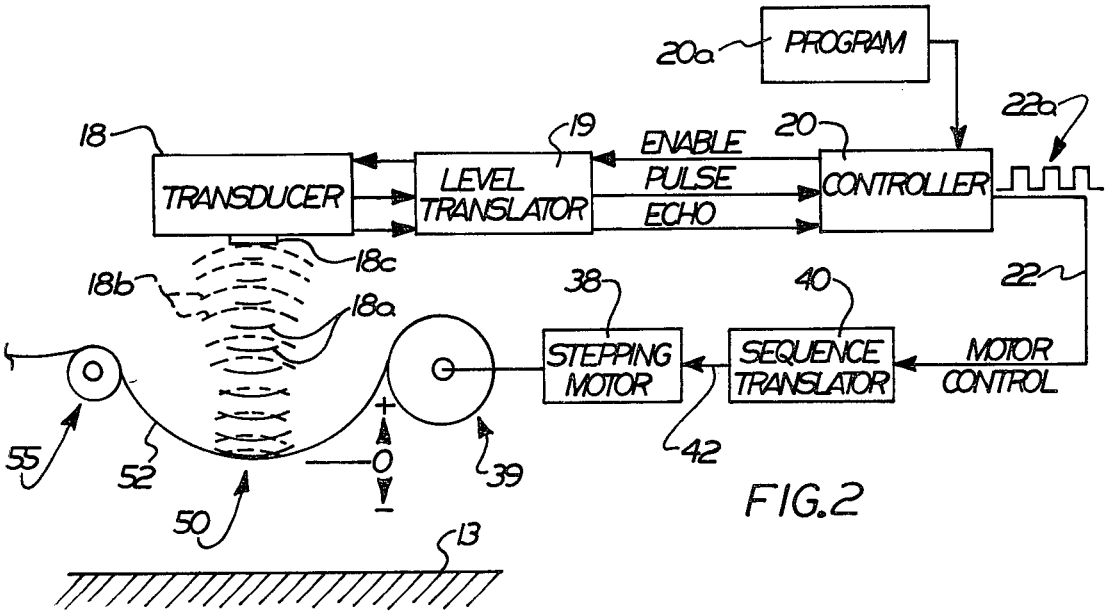
FIG. 2 is a schematic diagram of the controller of FIG. 1.

With reference to FIG. 2, there is schematically illustrated the apparatus of FIG. 1 from an electronic control standpoint.

A suitable transducer of the electrostatic type, used successfully in practicing the present invention, is manufactured and sold by Polaroid Corporation, of Cambridge, Massachusetts, and is known as the "Polaroid Ultrasonic Ranging Unit." The transducer 18, when enabled, will generate an interrogation pulse (lines 18*a*) constituted by eight cycles of 60 kilohertz ultrasound, followed by eight cycles of 57 kilohertz, followed by 16 cycles of 53 kilohertz ultrasound, followed by 24 cycles of 50 kilohertz ultrasound. The cycles of each frequency are rapidly sequenced and constitute the interrogation pulse (lines 18*a*) having a duration of approximately one millisecond. The use of four separate frequencies ensures that at least a portion of some of the interrogation pulse can be reflected as an echo back to the transducer 18 from the interrogated material (low point 50) which may be frequency-selective (i.e., absorbs certain frequencies of ultrasound while reflecting others).

The interrogation pulse is radiated downwardly (for example, one interrogation pulse every 70 msec) as illustrated by lines 18*a* and impinges on the low point 50 of the catenary-like section of material 52, where at least a portion of it is reflected back to the transducer 18 in echo-like fashion. The reflected echo/pulse (lines 18*b*) and the interrogation pulse lines 18*a* are received by and generated by an electrostatic, foil-like diaphragm 18*c* powered by an electronic power supply and pulse control circuit known in the art.

The transducer 18, after being enabled, will provide a pair of control pulses (interrogation and corresponding echo) which are fed via signal lines to a conventional level translator 19 (providing digital output from analog-type input) having corresponding output lines that are inputted to the controller 20, preferably in the form of a digital computer constituted by a single microcomputer-integrated circuit, such as a Series MK 38P74, as manufactured by Mostek Corporation, of Carrollton, Tex. This microcomputer is especially suited for control applications in that it has 32 input/output ports, an internal interval timer, and an external interrupt port. The noted integrated circuit (MK 38P74) is programmed (illustrated by block 20*a*) via a program control-integrated circuit, such as a Series 2758 EPROM (electronically programmable read only memory, 8 bits × 1024 bytes), also manufactured and sold by Mostek Corp., that plugs piggyback fashion into the processor controller (MK 8P74).

In accordance with a suitable program 20*a* contained in the EPROM, an output signal line 22 from the controller 20 provides digital type, direct current pulses (illustrated as signal waveform 22*a* -symmetrical −50 percent duty cycle) whose frequency determines the stepping rate of the stepper motor 38, a conventional sequence translator 40 being provided to convert the digital pulsing on the pulse line 22 into the required switching sequence needed to incrementally drive the permanent magnet d.c. stepping motor 38. The motor 38, in response to the pulse signal 22*a*, will rotate its output shaft and the coupled reel through a plurality of angular motions of generally uniform magnitude, the frequency of the pulses determining the rotation rate of the motor. A suitable direct current stepping motor and associated sequence translator are manufactured and sold by The Superior Electric Company, of Bristol, Conn. A direct current stepping motor is preferred, since it provides ideal starting torque and braking characteristics for heavy reel loads and is easily controlled to minimize inertia-generated shocks imposed on the catenary-like section. Further, it is particularly suited to be controlled directly by the digital output of a microcomputer as discussed above. It is clearly contemplated that a digital-to-analog converter could be provided in place of the translator 40 to regulate a conventional variable speed DC servomotor (in place of the stepping motor 38) as an alternative embodiment of the invention).

A typical operating sequence of the catenary controller of the present invention will now be discussed under the assumption that the reel 39 is rotating in a clockwise direction (as viewed in FIGS. 1 and 2) to take up material 52 from the catenary-like section suspended or hanging between the reel 39 (or a reel-associated support) and the support point 55.

In accordance with the present invention, the low point 50 of the catenary section is maintained at a predetermined normal distance, e.g., 26 inches (shown at level "0"), away from the transducer 18, and thus a set distance (e.g., 18 inches) above the floor 13 which supports the control unit 10 and the reel unit 30 (see FIG. 1). If the feed rate of the material from the support point 55 into the catenary-like section increases, the low point 50 will drop down into a lower control zone (−) In so doing, the time between generating the interrogation pulse and receiving the reflected echo pulse will increase. This increase in time, which translates to a greater distance between the transducer 18 and the low point 50 of the catenary-like section, will cause the controller 20 to increase the frequency of the pulse signal 22*a* by predetermined increments in accordance with the program 20*a* contained in the program integrated circuit (EPROM). This increased pulse frequency will in turn cause the stepping motor 38 to move in uniform angular increments at a higher rate to increase the rotational take-up speed of the reel 39 and thus raise the low point 50 of the section upwardly to its normal "0" position. For each pulse outputted from the controller 20, the stepping motor 39 will advance by 1.8 degrees, for example. As noted earlier, there is a 3:1 reduction between the driven sprocket 36 and the drive sprocket 38*b* (located on the reel unit 30; see FIG. 1) so that the reel 39 moves less than 1.8 degrees for each pulse provided by the controller 20 to the translator 40.

Conversely, a decrease in the feed rate of the material into the catenary-like section will cause the low point 50 to rise into an upper control zone level (+) wherein the distance between transducer 18 and the section low point 50 decreases, resulting in a shorter time period between interrogation pulse generation and detection of the corresponding reflected echo. This shorter period of time causes the controller 20 to decrease in predetermined increments the frequency of the pulse signal 22*b* so as to slow down the rotation rate of the stepping motor 38, and thus lower the section low point 50 back to its normal "0" level position.

It is to be noted that the control circuit as discussed above would generally operate in an opposite manner, with the reel 39 rotating in a counterclockwise direction (as viewed in FIGS. 1 and 2) to dispense material into the catenary-like section for feeding to an external means via the support point 55.

A clearer understanding of a typical operating sequence of the present invention can be had with reference to FIGS. 2A, 3, 4, and 5, which illustrate the programmed regulation of the stepping motor 38 by the controller 20 in accordance with the time durations between interrogation pulse generation and echo portion return generated by the transducer 18, the controlling operation being determined by the preprogrammed integrated circuit EPROM noted earlier. It is to be understood that programs other than that following could be utilized in practicing the invention.

Figure 2A:
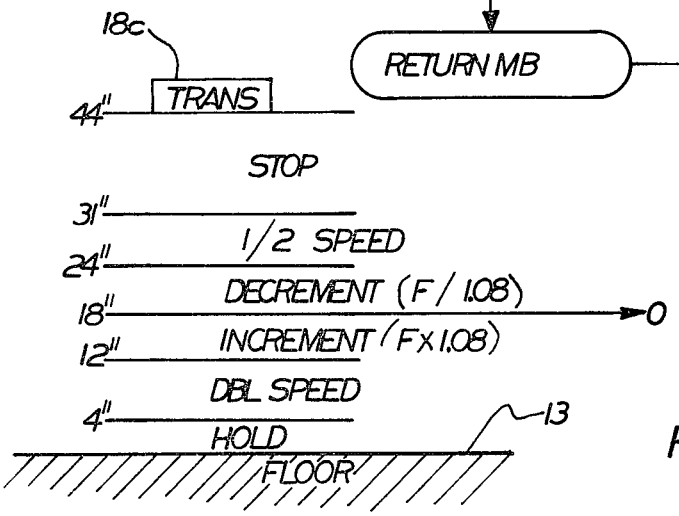
FIG. 2*a* illustrates a sensor zone layout used successfully in practicing the present invention.

With reference to FIG. 2A, there is illustrated a sensor zone layout extending over a 44-inch vertical distance between the transducer diaphragm 18C and the floor 13, this layout having been successfully used in practicing the present invention, wherein the reel 39 (see FIGS. 1 and 2) is rotating to take up material from the catenary-like section.

As discussed earlier, the low point 50 (FIG. 2) of the catenary-like section of traveling material is desirably maintained at or near a "0" or normal position. As illustrated in FIG. 2A, the normal position ("0" level) was chosen to be 18 inches above the floor or, conversely, 26 inches below the transducer, the distance between the transducer and the floor being chosen at 44 inches, as noted above. With the low point 50 of the catenary-like section detected at the normal "0" level, the frequency of pulses to the stepper motor 38 (FIG. 2) will remain constant for a constant feed rate of material. If the feed rate of material into the catenary-like section increases, the low point 50 of the catenary-like section will tend to drop into an "increment" zone illustrated as extending between the 18-inch level ("0" level) and a level 12 inches from the floor (i.e., the increment zone extends downwardly 6 inches from the normal position of the section low point).

In the illustrated preferred embodiment utilizing the zone layout of FIG. 2A, the transducer 18 senses the position of the section low point approximately every 70 milliseconds. When the low point of the section is sensed as being within the increment zone (12 to 18 inches above the floor), the frequency of pulses driving the stepper motor will be incremented (multiplied) by a factor of 1.08 (at predetermined intervals e.g. 70 msec) so as to provide for a gradually increasing frequency (to a predetermined limit), which will gradually increase the rate of rotation of the reel 39 (FIG. 2) so as to raise the low point of the section back to its normal "0" level. If the low point of the catenary-like section should continue downwardly (rapidly increasing feed rate), it will enter a "double speed" zone extending downwardly from the 12-inch level, constituting the lower boundary of the "increment" zone to a 4-inch level above the floor 13. When the low point of the section is in the "double speed" zone, the last frequency provided to the motor while the low point 50 was is in the increment zone will be doubled. After another period of time (e.g. 70 msec), it will again be doubled, until a maximum speed is reached. This will tend to raise the low point of the catenary-like section rapidly upwardly back to the normal "0" level via the "increment" zone (last frequency is halved and remains constant as low point moves from "double speed" zone to "0" via "increment" zone). If the low point of the section still does not move upwardly, and continues to fall into a lower "hold" zone extending from the floor 13 upward to a 4-inch level (indicating excessive feed rate or a break in the material forming the catenary-like section), pulses (22*b*-See FIG. 2) to the stepper motor 38 will remain at its last speed, and the rotation rate of the reel 39 will not change.

In a situation where the rate of feed of material 52 into the catenary-like section decreases without a corresponding decrease in the rotary feed of the reel, the low point of the catenary-like section will rise into a decrement section extending upwardly from the 18-inch normal "0" level to a 24-inch level, wherein in a manner similar to that discussed with regard to the "increment" zone (12"–18"), the frequency of drive pulse to the stepper motor will be decremented (divided) by a factor of 1.08 (at predetermined intervals e.g. 70 msec sample time) to gradually decrease it and thus allow the low point of the catenary-like section to move downwardly back to the 18-inch normal "0" level. If the section low point 50 (FIG. 2) continues to rise into a "½ speed" zone extending upwardly from the 24-inch level to a 31-inch level, the last frequency applied to the drive motor when the section low point was in the "decremented" zone will be halved at predetermined intervals (e.g. 70 msec) until a predetermined low speed limit is reached, wherein the section low point will rapidly move downwardly towards its normal 18-inch level via the "decrement" zone (last frequency is doubled and remains constant as low point moves from "½ speed" zone to "0" level via "decrement" zone). If the low point of the section should continue to move upwardly out of the "half speed" zone, an upper "stop" zone extending upwardly from the 31-inch level to the 44-inch level will be entered, wherein pulses to the stepping motor will cease. An alarm-type switch can be triggered upon entry of the low point 50 into the upper "stop" zone to cease the feeding of material out of the catenary-like section.

It can be seen that the frequency of drive pulses applied to the motor is incremented or decremented a predetermined or fixed amount and then doubled or halved in order to maintain the low point of the catenary-like section at the 18-inch normal "0" level.

Figure 4:
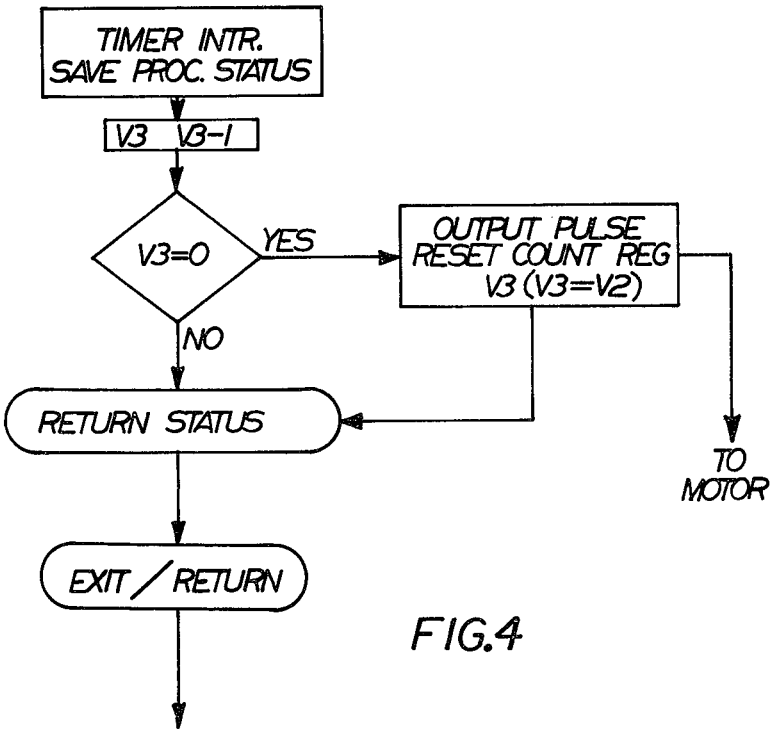
FIGS. 3, 4, and 5 illustrate flow charts typical of a suitable computer-controlled operation sequence for the catenary controller illustrated by FIGS. 1 and 2.
Figure 5:
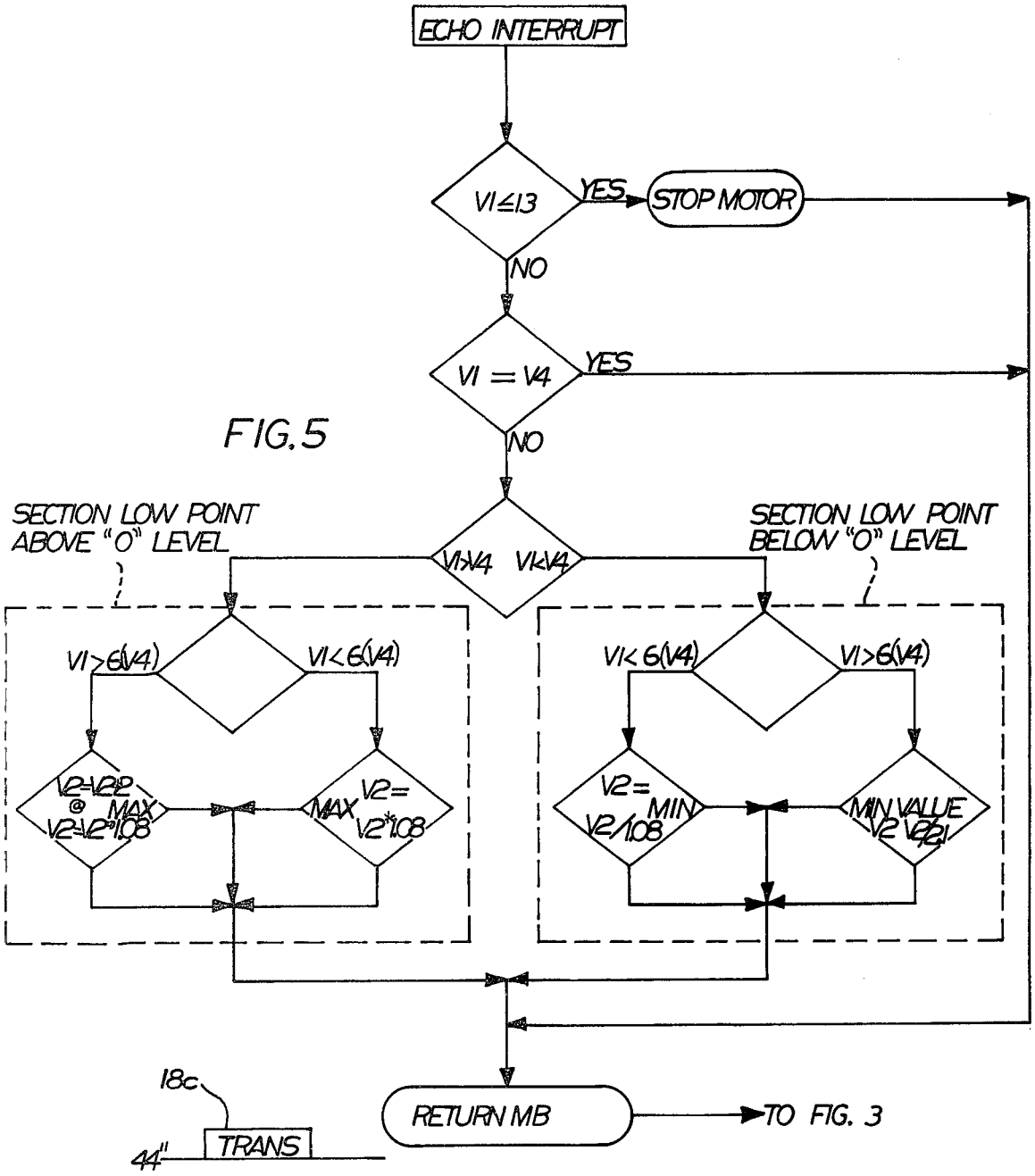
Figure 3:
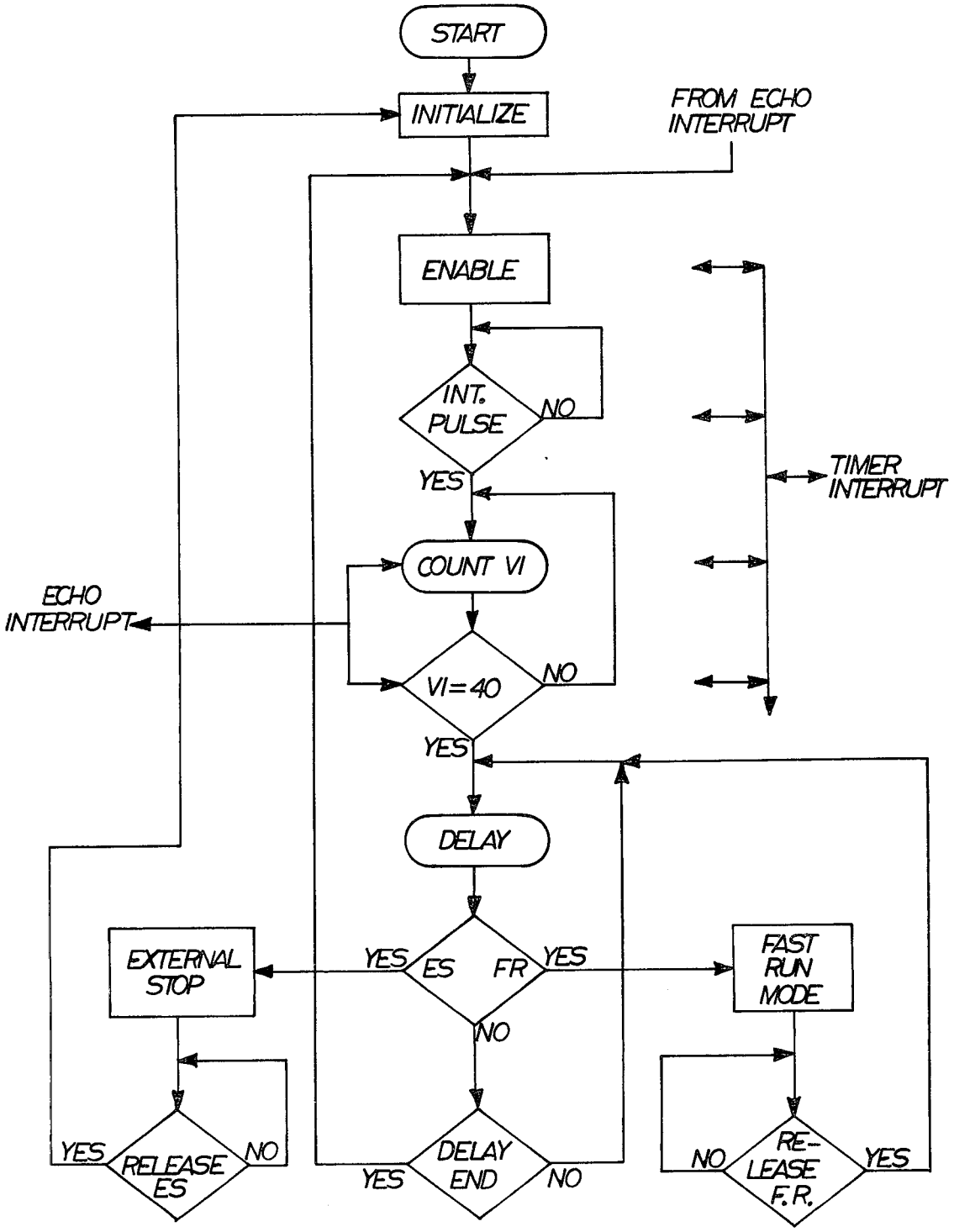

To maintain the low point 50 of the catenary-like section at the normal 18-inch "0" level, as discussed specifically with regard to FIG. 2A and as further discussed generally with regard to FIGS. 1 and 2, FIGS. 3, 4, and 5 illustrate in a flow chart fashion a program successfully utilized by the microcomputer discussed earlier included as part of the controller 20 (see FIG. 1). It is to be noted that the program illustrated by FIGS. 3, 4, and 5 is simply an example of one control sequence that has been successfully practiced.

With specific reference to FIG. 3, a start switch or power switch on the controller 20 (FIG. 1) is energized, wherein initial conditions (initialization) for control of the catenary-like section are set up. For example, a pulse frequency of approximately 83 hertz is selected as a starting point for maintaining the section low point 50 at the normal "0" (26 inches from transducer; 18 inches above floor) level. After initialization, the controller 20 will send an "enable" signal (See FIG. 2) to the transducer 18 and then wait to receive a pulse (See FIG. 2) back from the transducer, such pulse indicating that an ultrasonic interrogation pulse (see lines 18*a*, FIGS. 1, 2) has been generated. If this pulse is not received, the controller will simply cycle as illustrated, indicating that a hardware malfunction has occurred necessitating correction before operation of the catenary controller can resume.

If a pulse indicative of an interrogation pulse generation is received by the controller 20, a normalized V1 count is initiated, wherein one count period is of a time duration equal to the time it takes for the interrogation pulse to travel out and back to the transducer over a one-inch interval. Thus, the controller will start counting (cycling in a count loop) upon receipt of a pulse from the transducer 18 indicative of interrogation pulse generation, the count continuing while the controller 20 waits for the return of an associated echo (indicated to the controller 20 by the transducer 18). If the count reaches 40 (corresponding to 40" level of FIG. 2*a*) without an echo (See FIG. 2) being sensed by the transducer, the controller 20 will then determine if either an external stop mode switch or a fast run mode switch has been energized. An external stop switch could be used by the operator to cease rotation of the reel taking up the material. If such an external stop is in fact activated, the controller 20 will continuously sense (cycle) to see if the external stop remains activated. When the external stop is deactivated, the controller will again return to the initialization point as illustrated in FIG. 3, to once again begin an interrogation pulse/echo sequence. In the case of a fast run mode activation, a switch, such as a push button switch, has been pressed to cause the reel to rotate at a high speed, such a function being useful when completing the filling of a reel manually. In a manner similar to that earlier discussed with respect to the external stop mode, the controller will continuously monitor the fast run mode switch to see if it is activated, and if activated will continue to cycle and to monitor its condition. When the fast run mode activating switch is released, the controller will return to the point in the program illustrated in FIG. 3 to then return to the point in the program immediately subsequent to the initialization step discussed earlier, wherein a pulse/echo sequence is again undertaken.

If neither the external stop nor fast run modes are activated, the controller will maintain pulse generation to the motor (a count of 40 indicating that the lower "hold" zone (40"–44" from transducer) may have been penetrated by the section low point 50 (FIG. 2).

With reference to FIG. 5, an echo interrupt routine is disclosed, such routine interrupting the main body program illustrated by FIG. 3 each time an echo (See FIG. 2) is received by the transducer 18. If an echo is received before the count V1 reaches 40 (as discussed earlier), the echo interrupt routine of FIG. 5 will run. As illustrated in FIG. 5, if the count V1 is equal to or less than 13 (i.e., if the low point of the catenary-like section is equal to or less than 13 inches away from the transducer-upper "stop" zone-FIG. 2*a*), the controller 20 will terminate drive pulses to stop the stepper motor. If the count is between 13 and 40 (indicative of the section low point being somewhere between 14 inches and 40 inches from the transducer), the controller 20 will then proceed to determine if the count is equal to a preset count V4, which in the illustrated case is equal to 26, which corresponds to the normal "0" level, i.e., 26 inches downwardly from the transducer or 18 inches above the floor. If the V1 count derived from the echo and the V4 preset by the user equal each other, this indicates that the low point of the catenary-like section is at its normal position ("0" level, see FIG. 2) and that the frequency of drive pulses to the motor should not be altered. If, on the other hand, V1 does not equal V4, this indicates that the catenary-like section is either above or below the normal position. When the low point of the section is below its normal sensed position (V1 greater than V4), the controller 20 will then determine if V1 is less than V4 plus 6 inches or greater than V4 plus 6 inches (i.e., the controller will determine if the catenary-like section low point is in the "increment" zone or the "double speed" zone, as discussed earlier with regard to FIG. 2A). If V1 is less than 6 plus V4, the frequency of the motor will be incremented by the factor 1.08 as discussed earlier and as illustrated in FIG. 5. On the other hand, if V1 is greater than V4 plus 6 inches, the frequency to the motor will be doubled.

Conversely, if the low point of the catenary-like section is above its normal position (V1 less than V4), the controller will then determine if V1 is less than V4 plus 6 inches or greater than V4 plus 6 inches. Dependent upon the position of the catenary-like section (i.e., whether it is in the decrement zone or the half-speed zone), the frequency of the drive pulses to the motor will be decremented by the 1.08 factor or the frequency of the pulses, and thus the motor speed, will be halved. After such an adjustment is made, a newly calculated value V2 is loaded into a register and the echo interrupt is completed, with control being returned to the main body of the program illustrated in FIG. 3. It can be seen that as the echo return time varies, the resultant registry stored value V2 will vary in accordance with the zone at which the low point of the catenary-like section is detected.

FIG. 4 illustrates a conventional time interrupt routine which actually changes the speed of the motor by varying the frequency of the pulse output driving it. A register, which includes the value V2, is associated with another register V3, which in turn is associated with the timer. The count V3 (decremented) determines the time-out period of the timer, the timer counting down until it reaches zero, wherein an interrupt signal is generated. If at the time of the interrupt, V3 is equal to zero, then a pulse is applied to the motor and the value of V2 is substituted for the value of V3 and the countdown procedure begins once again, with V3 incrementing downwardly by one for each interrupt. Thus, by changing the value of V2 in accordance with the echo return count provided by the echo interrupt routine of FIG. 5, the frequency of pulses driving the stepping motor will increase or decrease incrementally, or will half or double so as to maintain the low point of the catenary-like section as at zero position illustrated in FIG. 3.

The use of a microcomputer as applied in the present invention allows programming of the control unit 20 for different applications where different zone layouts (FIG. 2*a*) may be desired. Further, while a one-inch resolution has been illustrated, a tenth-of-an-inch resolution (4000 counts -0.1 to 40 inches from transducer) can easily be provided where such increased resolution is desired. Further, the present invention has proved to be operable in factory environments where airborne dirt, dust, oil mist, and the like, could prove detrimental to other types of catenry controllers. Further, high ambient noise conditions, typical of a factory environment, have been found not to affect reliable operation of the present invention. Further, the present invention is not an ON-OFF type catenary controller, but rather generally continuously adjusts reel speed (at 70 msec intervals as illustrated) to control the catenary section of material.

The following machine language program has been utilized to successfuly accomplish the teachings as discussed with regard to FIGS. 1 through 5 and is included herein as follows..

| Address | Hex Listing | | | | | | | | | | | | | | | | |
|---|---|---|---|---|---|---|---|---|---|---|---|---|---|---|---|---|---|
| ØØØØ | 73 | BØ | 2Ø | 1F | B1 | 7Ø | B4 | B5 | 78 | 54 | 55 | 7F | 53 | B7 | A4 | 52 | Initialize |
| ØØ1Ø | 21 | 7F | 94 | Ø5 | 42 | 22 | 1A | 52 | 2Ø | CE | 57 | B6 | 1B | 29 | ØØ | 3C | Initialize |
| ØØ2Ø | 5Ø | 1E | 35 | 94 | Ø9 | 44 | 55 | A1 | 23 | Ø1 | 21 | 7F | B1 | 1D | 4Ø | 1B | Interrupt |
| ØØ3Ø | 1C | FF | FF | FF | FF | FF | FF | FF | FF | FF | FF | FF | 7Ø | 1F | 94 | FE | |
| ØØ4Ø | A1 | 22 | Ø2 | 21 | 3D | B1 | A1 | 91 | FE | 7Ø | 51 | 47 | 22 | Ø1 | 57 | B6 | Main Body |
| ØØ5Ø | 2B | 2B | 2B | 2B | 2Ø | F3 | 1F | 94 | FE | 71 | C1 | 51 | 25 | 28 | 94 | F5 | Main Body |
| ØØ6Ø | 72 | BØ | 47 | 21 | FE | 57 | B6 | A1 | 22 | Ø2 | 21 | 7F | B1 | 2Ø | Ø5 | 5A | Main Body |
| ØØ7Ø | 2Ø | FF | 5B | A1 | 21 | 4Ø | 94 | ØE | A1 | 21 | 2Ø | 94 | ØC | 3B | 94 | F4 | Main Body |
| ØØ8Ø | 3A | 94 | FB | 9Ø | BC | 29 | Ø1 | AØ | 29 | Ø1 | 85 | FF | FF | FF | FF | FF | Main Body |
| ØØ9Ø | FF | FF | FF | FF | FF | FF | FF | FF | FF | FF | FF | FF | FF | FF | FF | FF | |
| ØØAØ | 47 | 21 | FE | 57 | B6 | 1B | 71 | BO | 7D | 18 | C1 | 24 | Ø1 | 81 | ØB | 47 | |
| ØØBØ | 21 | F7 | 57 | B6 | 41 | 56 | 29 | Ø2 | ØØ | 47 | 22 | Ø8 | 57 | B6 | 42 | 21 | Echo Interrupt |
| ØØCØ | 7F | E1 | 84 | F1 | 42 | 21 | 7F | 18 | C1 | 58 | 81 | ØB | 48 | 18 | 58 | 42 | Echo Interrupt |
| ØØDØ | 21 | 8Ø | 84 | 58 | 9Ø | ØA | 48 | 24 | Ø1 | 58 | 42 | 21 | 8Ø | 94 | 4D | 48 | Echo Interrupt |
| ØØEØ | 18 | 24 | Ø7 | 81 | 1F | 2B | 2B | 2B | 2B | 2B | 44 | 25 | Ø4 | 84 | ØB | 44 | Echo Interrupt |
| ØØFØ | 12 | 54 | 2Ø | 1Ø | 53 | B7 | 2B | 9Ø | BC | 43 | 25 | Ø8 | 84 | B7 | 33 | 43 | Echo Interrupt |
| Ø1ØØ | B7 | 9Ø | B2 | 44 | 25 | Ø4 | 84 | 1D | 43 | 25 | Ø8 | 84 | ØA | 33 | 43 | B7 | Echo Interrupt |
| Ø11Ø | 9Ø | FØ | 78 | 54 | 53 | B7 | 44 | 25 | Ø8 | 84 | E7 | 44 | 12 | 54 | 2Ø | 1Ø | Echo Interrupt |
| Ø12Ø | 53 | B7 | 9Ø | DE | 43 | 25 | 1Ø | 84 | EA | 9Ø | OC | 48 | 18 | 24 | Ø7 | 91 | Echo Interrupt |
| Ø13Ø | 32 | 43 | 25 | 1Ø | 84 | Øa | 71 | C3 | 53 | B7 | 41 | 56 | 29 | Ø2 | ØØ | 44 | Echo Interrupt |
| Ø14Ø | 25 | 8Ø | 94 | Ø6 | 2Ø | 4Ø | 54 | 9Ø | F2 | 44 | 25 | 4Ø | 94 | Ø6 | 2Ø | 2Ø | Echo Interrupt |
| Ø15Ø | 54 | 9Ø | E8 | 44 | 25 | 2Ø | 84 | E3 | 78 | 53 | B7 | 44 | 13 | 54 | 9Ø | DB | Echo Interrupt |
| Ø16Ø | 2B | 2B | 46 | 18 | C1 | 81 | D4 | 43 | 25 | 1Ø | 94 | ØE | 44 | 25 | 8Ø | 84 | Echo Interrupt |
| Ø17Ø | CA | 44 | 13 | 54 | 78 | 53 | B7 | 9Ø | C2 | 71 | C3 | 53 | 25 | 1Ø | 84 | BA | Echo Interrupt |
| Ø18Ø | 9Ø | B5 | FF | FF | FF | 1A | 47 | 21 | F6 | 57 | B6 | 2Ø | FF | B5 | 7Ø | 1F | D/A Convert |
| Ø19Ø | 94 | FE | A1 | 21 | 2Ø | 84 | Ø7 | A1 | 21 | 1F | B1 | 9Ø | F2 | 29 | ØØ | ØØ | D/A Convert |
| Ø1AØ | 7D | 18 | C6 | 24 | Ø1 | 91 | ØA | 47 | 22 | Ø8 | 57 | 2Ø | 28 | B5 | 9Ø | Ø4 | D/A Convert |
| Ø1BØ | 2Ø | FF | B5 | 47 | 21 | FE | 57 | B6 | 78 | 54 | 53 | B7 | 7Ø | 1F | 94 | FE | D/A Convert |
| Ø1CØ | A1 | 21 | 4Ø | 84 | Ø7 | A1 | 21 | 3F | B1 | 9Ø | F2 | 47 | 21 | F7 | 57 | B6 | D/A Convert |
| Ø1DØ | 2Ø | FF | B5 | 29 | ØØ | 4Ø | FF | FF | FF | FF | FF | FF | FF | FF | FF | FF | |
| Ø1EØ | FF | FF | FF | FF | FF | FF | FF | FF | FF | FF | FF | FF | FF | FF | FF | FF | |
| Ø1FØ | FF | FF | FF | FF | FF | FF | FF | FF | FF | FF | FF | FF | FF | FF | FF | FF | |
| Ø2ØØ | 43 | 15 | 5A | 47 | 21 | Ø8 | 94 | Ø7 | 2Ø | FF | B5 | 29 | ØØ | 62 | 44 | 12 | Stop |
| Ø21Ø | 12 | 12 | 94 | Ø4 | 7Ø | 9Ø | 1A | 12 | 94 | Ø4 | 71 | 9Ø | 14 | 12 | 94 | Ø4 | Stop |
| Ø22Ø | 72 | 9Ø | ØE | 12 | 94 | Ø4 | 73 | 9Ø | Ø8 | 12 | 94 | Ø4 | 74 | 9Ø | Ø2 | 75 | High Speed |
| Ø23Ø | 5B | 4A | 24 | ØØ | 94 | Ø3 | 2Ø | 7Ø | EB | Ø7 | 72 | Ø6 | ØF | 16 | 18 | B5 | High Speed |
| Ø24Ø | 9Ø | CA | FF | FF | FF | FF | FF | FF | FF | FF | FF | FF | FF | FF | FF | FF | |
| Ø25Ø | FF | FF | FF | FF | FF | FF | FF | FF | FF | FF | FF | FF | FF | FF | FF | FF | |
| Ø26Ø | FF | FF | FF | FF | FF | FF | FF | FF | FF | FF | FF | FF | FF | FF | FF | FF | |
| Ø27Ø | D7 | AF | 87 | 5F | 37 | ØF | FF | FF | FF | FF | FF | FF | FF | FF | FF | FF | D/A Look-Up |
| Ø28Ø | FF | D7 | AF | 87 | 5F | 37 | FF | FF | FF | FF | FF | FF | FF | FF | FF | FF | D/A Look-Up |
| Ø29Ø | FA | D2 | AA | 82 | 5A | 32 | FF | FF | FF | FF | FF | FF | FF | FF | FF | FF | D/A Look-Up |
| Ø2AØ | F5 | CD | A5 | 7D | 55 | 2D | FF | FF | FF | FF | FF | FF | FF | FF | FF | FF | D/A Look-Up |
| Ø2BØ | FØ | C8 | AØ | 78 | 5Ø | 28 | FF | FF | FF | FF | FF | FF | FF | FF | FF | FF | D/A Look-Up |
| Ø2CØ | EB | C3 | 9B | 73 | 4B | 23 | FF | FF | FF | FF | FF | FF | FF | FF | FF | FF | D/A Look-Up |
| Ø2DØ | E6 | BE | 96 | 6E | 46 | 1E | FF | FF | FF | FF | FF | FF | FF | FF | FF | FF | D/A Look-Up |
| Ø2EØ | E1 | B9 | 91 | 69 | 41 | 19 | FF | FF | FF | FF | FF | FF | FF | FF | FF | FF | D/A Look-Up |
| Ø2FØ | DC | B4 | 8C | 64 | 3C | 14 | FF | FF | FF | FF | FF | FF | FF | FF | FF | FF | D/A Look-Up |
| Ø3ØØ | FF | FF | FF | FF | FF | FF | FF | FF | FF | FF | FF | FF | FF | FF | FF | FF | |
| Ø31Ø | FF | FF | FF | FF | FF | FF | FF | FF | FF | FF | FF | FF | FF | FF | FF | FF | |

Although a preferred embodiment of this invention has been shown and described, it should be understood that various modifications and rearrangements of the parts may be resorted to without departing from the scope of the invention as disclosed and claimed herein.

What is claimed is:

1. Apparatus for maintaining a catenary-like section of traveling material suspended between a support point and a rotating reel collecting or dispensing the material comprising:

a stepping motor for rotatably driving the reel in discrete angular motions of generally uniform magnitude;

a multifrequency ultrasonic transducer positionable in spaced relation from the catenary-like section and operable in the pulse/echo mode to sense the position of the section, the transducer providing an output signal indicative of the section position relative to the transducer, the said output signal being derived in part from a reflected portion of a radiated interrogation pulse generated by the transducer, the interrogation pulse comprising a sequence of ultrasonic signals of different frequencies, at least a portion of one of said ultrasonic signals being reflected by the catenary-like section back to the transducer to constitute said reflected portion from which said output signal is derived; and a control means responsive to the transducer output signal for regulating the frequency of discrete angular motions of the stepping motor driver reel to maintain the catenary-like section at a predetermined position relative to the transducer.

2. Apparatus according to claim 1, wherein the control means is operable to change the frequency of discrete angular motions of the stepping motor in fixed increments as the low point of catenary-like section moves downwardly and upwardly from a predetermined normal position.

3. Apparatus according to claim 2, wherein, with the reel rotatable in a direction to collect traveling material from the catenary-like section, the control means is operable to increase in fixed increments the frequency of discrete angular motions of the stepping motor-driven reel as the low point of the section moves downwardly by predetermined amounts from said normal position, the control means being operable to decrease in fixed increments the frequency of discrete angular motions of the stepping motor-driven reel as the low point of the section moves upwardly by predetermined amounts from said normal position, said increasing and decreasing tending to maintain the section low point generally at said normal position.

4. Apparatus according to claim 2, wherein, with the reel rotatable to dispense traveling material to the catenary-like section, the control means is operable to decrease in fixed increments the frequency of discrete angular motions of the stepping motor-driven reel as the low point of the section moves downwardly by predetermined amounts from said normal position, the control means being operable to increase in fixed increments the frequency of discrete angular motions of the stepping motor-driven reel as the low point of the section moves upwardly by predetermined amounts from said normal position, said decreasing and increasing tending to maintain the section low point at said normal position.

5. Apparatus according to claims 3 or 4, wherein said transducer is movable to facilitate positioning of the transducer generally directly above the low point of the catenary-like section.

6. Apparatus according to claims 3 or 4, wherein said control means includes a variable frequency signal generator for driving the stepping motor.

7. Appratus for maintaining a catenary-like section of traveling material suspended between a support point and a rotating reel collecting or dispensing the material comprising:

a direct current, permanent magnet stepping motor having a rotatable drive shaft adapted to be positively coupled to the reel to rotate it, the shaft being rotatable in discrete angular motions of generally uniform magnitude, a direct current drive pulse advancing the stepping motor by one of said angular motions;

a multifrequency ultrasonic transducer positionable in spaced relation a predetermined distance generally above the low point of the catenary-like section, the transducer being operable in the pulse/echo mode to sense the distance between the transducer and the section low point, the transducer providing an output signal indicative of said distance, the said output signal being derived in part from a reflected portion of a radiated interrogation pulse generated by the transducer, the interrogation pulse comprising a sequence of ultrasonic signals of different frequencies, at least a portion of one of said ultrasonic signals being reflected by the catenary-like section back to the transducer to constitute said reflected portion from which said output signal is derived; and a control means responsive to the transducer output signal for providing a plurality of said direct current drive pulses at a frequency determined by said distance to maintain the section low point at said predetermined distance from the transducer.

8. Apparatus according to claim 7, including a chain-type drive means coupling said motor shaft to a bearing-supported rotatable sprocket for driving and supporting the reel.

9. An electronic controller for maintaining a catenary-like section of traveling material suspended between a support point and a rotating motor-driven reel collecting or dispensing the material comprising:

a multifrequency ultrasonic transducer positionable a spaced distance from the low point of the catenary-like section, the transducer providing an output signal indicative of the distance between the low point and the transducer, the said output signal being derived in part from a reflected portion of a radiated interrogation pulse generated by the transducer, the interrogation pulse comprising a sequence of ultrasonic signals of different frequencies, at least a portion of one of said ultrasonic signals being reflected by the catenary-like section back to the transducer to constitute said reflected portion from which said output signal is derived; and control means responsive to the output signal for varying the rotation rate of the motor-driven reel to maintain the section low point a predetermined distance from the transducer.

10. An electronic controller for maintaining a catenary-like section of traveling material suspended between a support point and a rotating motor-driven reel collecting or dispensing the material comprising:

a multifrequency ultrasonic transducer positionable generally directly above and in spaced relationship from the low point of the catenary-like section, the transducer being operable to generate and downwardly radiate an ultrasonic interrogation pulse that impinges on the section low point and, at least in part, is reflected back to and detected by the transducer, the transducer in response to said generation and detection providing an output signal indicative of the time period between generating and detecting said interrogation pulse, the said output signal being derived in part from the reflected back portion of the interrogation pulse, the interrogation pulse comprising a sequence of ultrasonic signals of different frequencies, at least a portion of one of said ultrasonic signals constituting said reflected back portion of the interrogation pulse, said time period being indicative of the distance between the transducer and the section low point generally at the time of said generating; and control means responsive to said transducer output signal, the control means providing a variable frequency digital signal for regulating the rotational speed of the motor, the frequency of the signal determining the rate of rotation of the motor, the control means maintaining the section low point generally at a predetermined distance from the transducer.

11. An electronic controller according to claim 10, wherein said output signal consists of pulse pairs, the first pulse of each pair being generated generally at the time of said radiation of said interrogation pulse, the second pulse of each pair being generated generally at the time of reception of said associated reflected portion by the transducer, the control means enabling the transducer prior to each of said pairs.

12. An electronic controller according to claim 11, including a vertical support member positionable adjacent to said catenary-like section, the upper portion of the vertical support having a horizontal cantilever-like arm extending outwardly to overhang the low point of the section, the distal end of the arm supporting the transducer in spaced relationship above the section low point.

13. An electronic controller according to claim 10, wherein said control means includes a preprogrammed digital computer operable to vary the said frequency in predetermined fixed increments dependent upon the distance between the transducer and the section low point.

14. An electronic controller according to claim 11, wherein said enabling occurs at less than one second intervals to generally continuously monitor the distance between section low point and the transducer.

* * * * *